US008404055B2

(12) United States Patent
Campbell

(10) Patent No.: US 8,404,055 B2
(45) Date of Patent: Mar. 26, 2013

(54) METHOD AND APPARATUS FOR TOUCHLESS CLEANING OF A CHANDELIER

(75) Inventor: Keith S. Campbell, East Kingston, NH (US)

(73) Assignee: Inventive Solutions, LLC, Exeter, NH (US)

( * ) Notice: Subject to any disclaimer, the term of this patent is extended or adjusted under 35 U.S.C. 154(b) by 1298 days.

(21) Appl. No.: 11/944,849

(22) Filed: Nov. 26, 2007

(65) Prior Publication Data

US 2009/0133721 A1 May 28, 2009

(51) Int. Cl.

| | |
|---|---|
| ***B08B 15/02*** | (2006.01) |
| ***B08B 13/00*** | (2006.01) |
| ***B08B 5/04*** | (2006.01) |
| ***B08B 3/04*** | (2006.01) |

(52) U.S. Cl. ..... 134/19; 134/21; 134/104.2; 134/104.3; 134/186; 134/187; 135/90; 135/96

(58) Field of Classification Search ..... 134/104.2, 134/104.3, 186, 187, 200, 201, 19, 21, 95.2, 134/95.3; 135/88.01, 90, 96, 912
See application file for complete search history.

(56) References Cited

U.S. PATENT DOCUMENTS

| | | | | |
|---|---|---|---|---|
| 4,911,191 | A * | 3/1990 | Bain | 134/200 |
| 5,024,246 | A * | 6/1991 | Bain | 134/200 |
| 5,062,871 | A * | 11/1991 | Lemon, III | 55/385.2 |
| 5,088,511 | A * | 2/1992 | Bain | 134/200 |
| 5,863,343 | A * | 1/1999 | Campbell | 134/1 |
| 2002/0157697 | A1 * | 10/2002 | Choi | 135/119 |

FOREIGN PATENT DOCUMENTS

| | | | |
|---|---|---|---|
| DE | 20003594 U1 * | 6/2000 | |
| JP | 06039354 A * | 2/1994 | |

OTHER PUBLICATIONS

Machine Translation of DE 20003594 U1 to Pichl, Jun. 2000.*
Machine Translation of JP 06039354 A to Kamieda et al., Feb. 1994.*

* cited by examiner

*Primary Examiner* — Michael Barr
*Assistant Examiner* — Benjamin L Osterhout
(74) *Attorney, Agent, or Firm* — Ronald E. Smith; Smith & Hopen, P.A.

(57) ABSTRACT

A chandelier cleaning apparatus includes a tent-like enclosure made of a transparent plastic. In a first embodiment, the enclosure includes a main body having a flat top panel and a flat, imperforate bottom panel. A central aperture is formed in the top panel and a zipper extends from the central aperture to an outer periphery of the top panel so that the central opening is enlarged when the zipper is open. The chandelier passes through the central aperture when the zipper is open and is enclosed within the enclosure when the zipper is closed. A mist of hot water is sprayed onto the chandelier with a wand that extends though a small opening in the enclosure. The time required to clean a typical chandelier drops from hours to minutes, no chemicals are used, and the chandelier is touched only by the hot mist.

17 Claims, 3 Drawing Sheets

10
12
13
14
15
16
17
18
19
19
20
21
22
24
24
26
26
28
30
32
34
36
36
40
40
42
44
46
48
50
52
54
56
58
60
62
64
11
HOT WATER
PUMP
DRYING
HOT AIR 24
24
10
13
32
14
26
22
20
26
11
16
12
30
40
28
42
64
46
40
52
36
44
36
18
48
34
58
15
21
54
HOT WATER
50
60
PUMP
62
DRYING
HOT AIR
56
17
19
19

METHOD AND APPARATUS FOR TOUCHLESS CLEANING OF A CHANDELIER

BACKGROUND OF THE INVENTION

1. Field of the Invention

This invention relates, generally, to cleaning devices. More particularly, it relates to an apparatus and method for cleaning chandeliers in about one-eighth the time as prior art devices and methods.

2. Description of the Prior Art

Chandeliers or other light fixtures are typically cleaned by a manual method that takes several hours, depending upon the size and style of the chandelier or other light fixture.

More particularly, the manual method includes scrubbing of the chandelier with chemicals to remove dirt from the various parts of the chandelier. This method is labor-intensive and time-consuming. Moreover, the chemicals attack the lacquer coating that protects the metal frame of the chandelier and oxides underlying the metal.

There is therefore a need for a cleaning method that takes minutes instead of hours. Moreover, there is a need for a cleaning method that does not employ chemicals.

The chemicals used in the prior art cleaning methods may be dispensed from bottle sprays. These devices are hand-pumped and heavy. Their use requires an unacceptable amount of repetitive motion because one to twenty bottles, at a minimum, may be needed to clean just one chandelier.

Thus there is a need for a cleaning method that reduces the amount of labor required to complete a job, that substantially eliminates repetitive movements, and that does not require the use of heavy bottles.

Manual scrubbing also results in at least a few broken crystals. Accordingly, there is a need for a touchless cleaning method that eliminates manual scrubbing.

However, in view of the art considered as a whole at the time the present invention was made, it was not obvious to those of ordinary skill in this art how the identified needs could be met.

SUMMARY OF INVENTION

The long-standing but heretofore unfulfilled need for an improved method and apparatus for cleaning chandeliers is now met by a new, useful, and nonobvious invention.

The novel apparatus for cleaning chandeliers includes a tent-like hollow enclosure having a predetermined shape adapted to house a chandelier therein. In a first embodiment, the tent-like enclosure includes a main body and a flat top panel formed integrally with or detachably secured to an upper peripheral edge of the main body. An imperforate floor panel is formed integrally with or detachably secured to a lower peripheral edge of the main body.

The entire top panel is preferably removable from the main body to facilitate positioning of the main body in enclosing relation to the chandelier or other fixture.

A slot is formed in the top panel that extends radially from the center of the top panel to a peripheral edge thereof. A closure means, preferably a zipper, is provided for selectively opening and closing the slot. The slot when open provides access into the interior of the main body. The slot is closed when the chandelier is disposed in the hollow interior of the main body.

In the first embodiment, an access door is formed in the main body and is hingedly secured to the main body by a living hinge. A door zipper engages the access door to the main body when the access door is closed, and the door zipper is unzipped to enable opening of the access door.

A support frame maintains a predetermined shape of the main body. The support frame includes a plurality of relatively rigid parts that cooperate with one another to hold the main body in the predetermined shape. The shape may be oblong, cylindrical, or any other shape adapted to fully house a chandelier. In the first embodiment, a first hoop having a predetermined shape is positioned at an upper peripheral edge of the main body, and a second hoop having the predetermined shape is positioned at a lower peripheral edge of the main body. The first and second hoops are oriented in a substantially horizontal plane and are interconnected to one another by a plurality of relatively rigid upstanding rods that are disposed in parallel, equidistantly and circumferentially spaced relation to one another.

The chandelier is not removed from its mount at any time. Most chandeliers depend from a ceiling hook or a chain and the novel enclosure is connected in depending relation to said ceiling hook or chain as well. In the alternative, a lift device is provided for supporting the tent-like enclosure from below when the enclosure cannot be easily attached in depending relation to a chain or ceiling hook. The lift device includes a base supported by wheels, a telescoping arm disposed in upstanding relation to the base, and a flat platform that surmounts the telescoping arm. The flat platform is adapted to support the imperforate floor panel of the tent-like enclosure so that the main body may be disposed in enclosing relation to the chandelier when the main body is not suspended from a chain or ceiling hook.

In the first embodiment, the cleaning apparatus further includes a dual-function hand-held wand having a nozzle at a distal end thereof, and at least one wand-accommodating port is formed in the main body of the enclosure. The wand has a proximal end in fluid communication with a mist pump that is in selective fluid communication with a reservoir of hot filtered or deionized water and a source of hot air. The pump is adapted to pump hot water through the lumen of the wand so that a hot mist is sprayed onto the chandelier. The pump is also adapted to pump hot air into the lumen of the wand so that the chandelier is dried by the hot air. The wand includes a flow control means so that an operator may control the flow rate of hot mist onto the chandelier.

Hot water in mist form is sprayed onto all of the surfaces of the chandelier, followed by blowing hot compressed air onto the chandelier to dry it. Both the mist of hot water and the hot air are delivered to the chandelier by the hand-held wand. The enclosure is then removed from its enclosing relation to the chandelier. Accordingly, the chandelier remains in its functional, operable position throughout the cleaning process, the chandelier is cleaned in the absence of manual scrubbing of its individual parts, the chandelier is cleaned in the absence of chemicals, and the time required to clean the chandelier is substantially reduced vis a vis manual chandelier cleaning procedures.

In a second embodiment, the misting function and the drying function of the hand-held wand are separated. The misting function is performed by a hand-held spray gun and the drying function is performed by a hand-held hot air dryer. The second embodiment also includes a hand-held water extractor for vacuuming water that collects at the bottom of the main body of the enclosure. The vacuum also removes water that collects on bobeches (bowls) and other areas on a chandelier that collect water.

The wand of the first embodiment and the spray gun of the second embodiment may be thought of as outside misters because they are provided as a separate part external to the enclosure and the leading or distal end of the wand or spray gun is placed into the interior of the enclosure through an enclosure port only when an operator worker is handling the wand or spray gun.

The second embodiment adds at least one inside mister that is built into the interior of the enclosure. Each inside mister is provided in the form of a length of pipe that has nozzle openings formed along its length. The pipe extends vertically along a wall of the main enclosure and has a bend formed therein where the main body of the enclosure joins an inclined top panel of the second embodiment. In this way, the fixed position inside misters can clean much of the chandelier or fixture and the hand-held wand or spray gun may be needed only as a back-up that is used on those spots that the inside misters cannot clean.

The hand-held hot air dryer is in fluid communication with a hot air blower. It is used to dry the chandelier after the hot mist is applied thereto. A hot air vent is formed in the main body of the enclosure and performs the function its name expresses. A temperature gauge mounted within the enclosure is adapted to shut off the hot air blower if the temperature within the enclosure exceeds a predetermined threshold. A pressure-relief valve is also formed in the main body of the enclosure to release pressure if the pressure within the enclosure exceeds a predetermined pressure.

The hand-held hot air dryer is also used to blow dust off the chandelier at the beginning of the cleaning procedure. Advantageously, the hand-held water extractor, which is in fluid communication with a vacuum source, and the hand-held hot air dryer are inserted into the hollow interior of the enclosure through ports formed in said enclosure and said devices are substantially simultaneously activated by an operator. The dust blown off by the hand-held hot air dryer is thus collected immediately by the hand-held water extractor. This procedure is the first step in the cleaning procedure. If a chandelier has no dirt that clings to it and merely needs a dusting, this first step of the procedure is the only step that is needed.

The second embodiment also includes a swivel device from which the novel tent-like enclosure depends. The swivel depends from a ceiling hook or from a support chain that supports the chandelier. At least two substantially non-stretchable lines interconnect the swivel and the novel structure. Each line has a first end secured to the swivel and a second end secured to the upper peripheral edge of the main housing.

The swivel enables an operator to easily rotate the enclosure about a vertical axis defined by the swivel. The rotation is performed during operation of the inside misters so that said inside misters are rotated about the stationary chandelier so that the hot water mist can be applied to the chandelier from all directions.

An important object of the invention is to provide an apparatus that cleans chandeliers in the absence of touching the chandelier surfaces.

Another important object is to provide a touchless cleaning system that employs only hot, filtered or deionized water, i.e., there being no chemicals applied to any surface. The use of deionized or filtered water inhibits or eliminates spotting. Avoiding the use of chemicals is important because harmful cleaning agents break down and remove the lacquer coating that protects the metal finish of most fixtures.

Yet another object is to provide an apparatus and method that reduces the time required to clean a typical chandelier from a number of hours to a number of minutes.

A more specific object is to provide a hand-held device that sprays a mist, which may range from light to heavy, of hot water onto a chandelier to clean it in the absence of manual scrubbing.

Another specific object is to provide a hand-held device that sprays hot air onto a chandelier to dry it.

Another object is to provide an enclosure that protects the environment of the chandelier during the cleaning process.

These and other important objects, advantages, and features of the invention will become clear as this description proceeds.

The invention accordingly comprises the features of construction, combination of elements, and arrangement of parts that will be exemplified in the description set forth hereinafter and the scope of the invention will be indicated in the claims.

BRIEF DESCRIPTION OF THE DRAWINGS

For a fuller understanding of the invention, reference should be made to the following detailed description, taken in connection with the accompanying drawings, in which.

DETAILED DESCRIPTION OF THE PREFERRED EMBODIMENT

There are two (2) primary embodiments of the invention, although each embodiment may include numerous modifications. The first generation of the invention is disclosed herein as the first embodiment, and an improved second generation is disclosed as the second embodiment.

Figure 1:
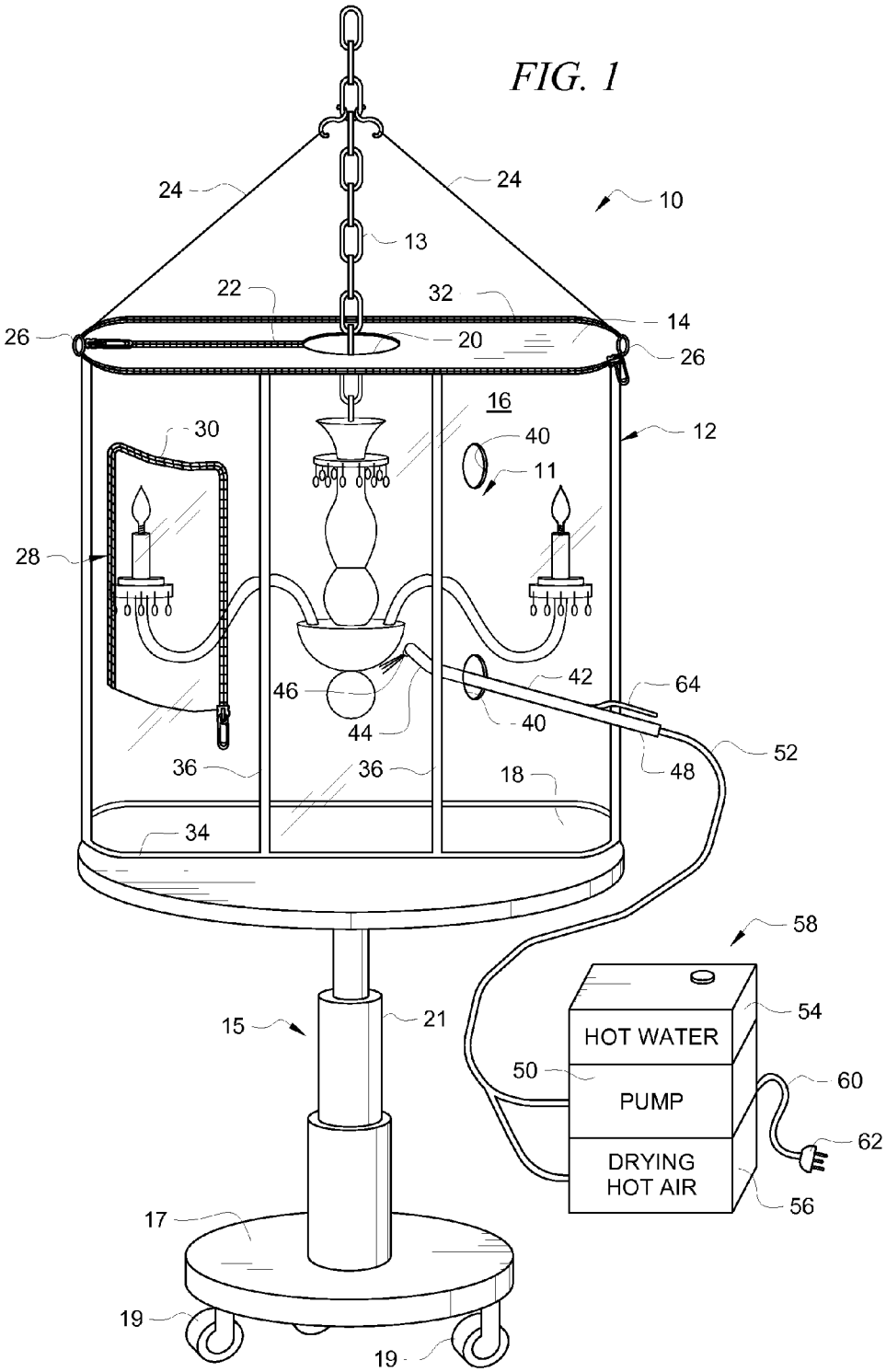
FIG. 1 is a perspective view of a first embodiment of the novel apparatus for cleaning chandeliers.
Figure 2:
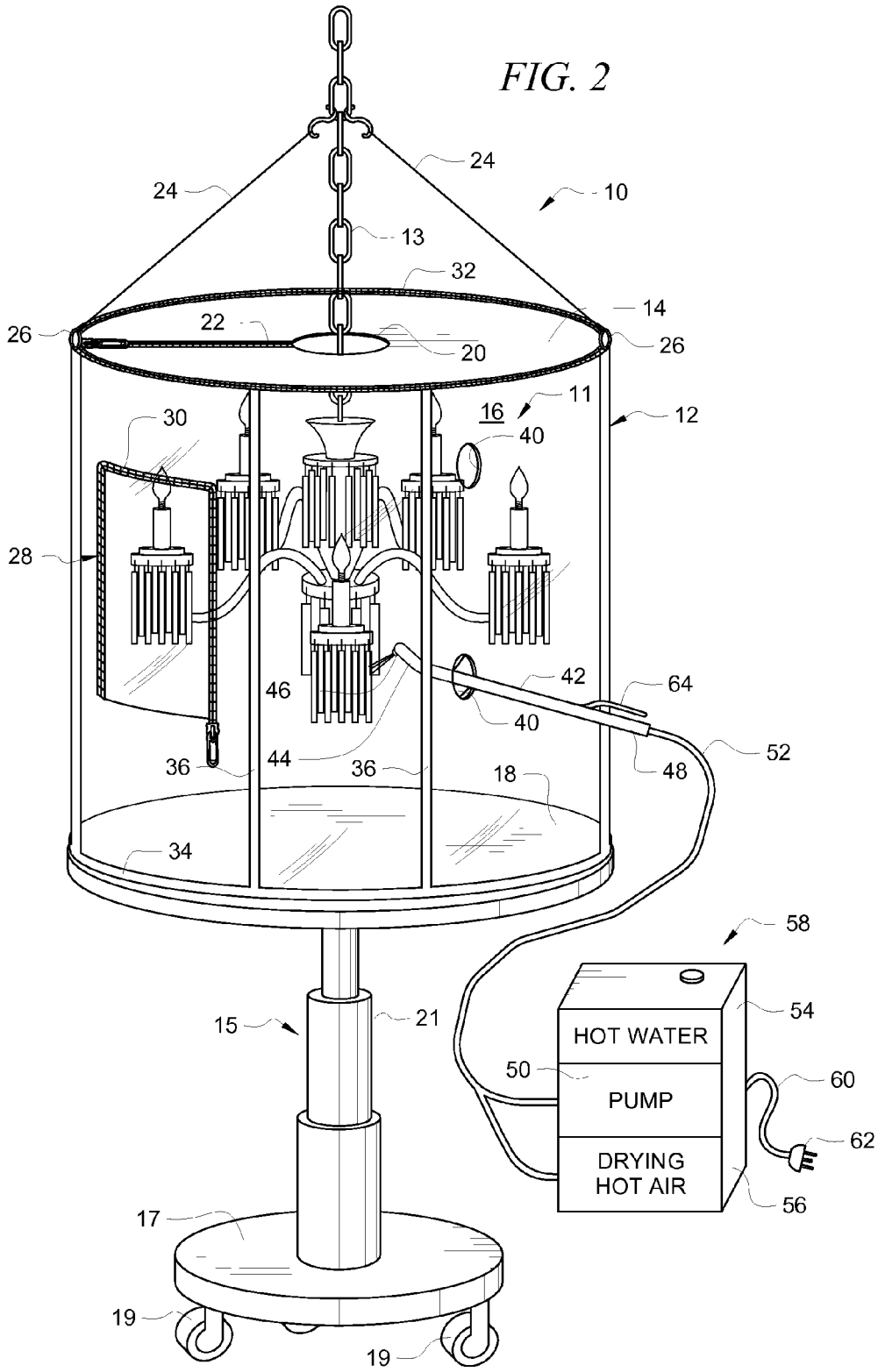
FIG. 2 is a perspective view of a structural variation of the first embodiment.

Referring now to FIGS. 1 and 2, it will there be seen that the first illustrative embodiment of the invention is denoted as a whole by the reference numeral 10.

The novel chandelier cleaner includes a tent-like chandelier enclosure 10 made of a clear, transparent plastic or other light-in-weight material. Enclosure 10 includes horizontally-disposed, flat top panel 12 that is formed integrally with or detachably secured to main body 14 at the top peripheral edge thereof and imperforate bottom panel 16 that is formed integrally with or detachably secured to said main body at a bottom peripheral edge thereof.

Bottom panel 16 is padded and double lined like an air mattress because any chandelier cleaning process will cause at least a few crystals to fall. The padding prevents such crystals from breaking.

Enclosure 10 is preferably formed of a lightweight, insulated plastic. It is light-in-weight so that it can be delivered to a fixture and raised to enclose the fixture while the fixture remains on its normal ceiling hook or chain mount. This overcomes the prior art problems associated with removing a fixture from its mount, taking it to a dishwasher or other cleaning means, and re-mounting it. The re-mounting requires handling of the fixture, thereby further soiling it. In contrast, the novel method is touchless and the fixture is never moved from its original mount.

Chandelier enclosure 10 collapses for transportation, is inexpensive to manufacture, and is large enough to enclose a large chandelier. It is also small enough to be held in a hand if it is desired to clean one small crystal at a time. Enclosure 10 may have any practical geometric configuration such as octagonal, spherical, square, and the like. It protects the surrounding environment, which may include paintings, furniture, marble floors, and the like, from contact with the dust plumes created during the dusting and air blowing steps of the novel cleaning process. It also contains the water used as well.

The plastic or other material is double-sided, i.e., lined for insulation and for support to retain its shape. The double-sided (lined) walls serve as an insulator in the same way that a thermal pane serves as an insulator in a window. The inside of the enclosure needs to be warm to heat up the fixture and crystal to about one hundred twenty to one hundred sixty degrees Fahrenheit (120°-160° F.) to ensure proper cleaning and drying. The double-sided walls also help maintain the shape of the enclosure. Air is introduced into the hollow interior of the enclosure to a predetermined pressure, thereby inflating the enclosure as if it were an air mattress. A single-sided wall may be used but a framework is then needed to help maintain its shape and the insulation properties of a single-sided wall are of course less than those of a double-sided wall.

In the first embodiment, depicted in FIGS. 1 and 2, top panel 12 includes central aperture 18 and a zipper 20 that extends from said central aperture to an outer periphery of said top panel. Zipper 20 is depicted in FIGS. 1 and 2 in its closed configuration. When zipper 20 is in an open configuration, central aperture 18 is enlarged so that chandelier 11 may pass therethrough into the hollow interior of main body 14. Zipper 20 is then returned to its closed position and chandelier 11 is housed within said hollow interior of main body 14 as depicted.

Any suitable fastening means may be used to suspend main body 14 from the same chain 13 or other support means that holds chandelier 11. In the illustrated embodiment, a plurality of substantially non-stretchable lines, collectively denoted 24, extend from said chain to attachment rings 26, 26 that are mounted on diametrically opposite points of the upper peripheral edge of said main housing.

It will be observed in FIG. 1 that main housing 14 has a generally oblong shape when viewed from the top or bottom. This is to accommodate the particular type of chandelier depicted in said FIG. 1, said chandelier having a narrow profile. It is therefore understood that a chandelier having a round or circular profile would preferably be enclosed in a main body having a cylindrical configuration as depicted in FIG. 2. However, main body 16 may have any geometric configuration as long as it encloses the chandelier without obstructing the cleaning procedure disclosed below.

Enclosure 10 further includes access door 28 formed in main body 14. Door 28 is preferably made of the same clear plastic as main body 14 and is interconnected to said main body when fully closed by zipper 30. Door 28 is preferably rectangular in configuration. Accordingly, any three (3) of its four (4) sides may be provided with a zipper so that a fourth side may form a living hinge. In the embodiment of FIGS. 1 and 2, the living hinge is one of the vertical sides.

Support frame 32 includes several relatively rigid metallic or plastic parts that cooperate with one another to hold top panel 12 and main body 14 in their respective desired shapes. In the embodiment of FIG. 1, the oblong shape of main body 14 is maintained by first oblong hoop 34 positioned at the upper peripheral edge of said main body and by second oblong hoop 36 positioned at the lower peripheral edge of said main body. Hoops 34 and 36 are oriented in a substantially horizontal plane and are interconnected by a plurality of relatively rigid upstanding rods, collectively denoted 38, that are disposed in parallel, equidistantly and circumferentially spaced relation to one another.

Top panel 12 and main body 14 may be formed integrally with one another but are preferably releasably engaged to one another by any suitable fastening means such as zippers, snaps and buckles, hook and loop fasteners, and the like.

FIG. 2 depicts a cylindrical enclosure for use with chandeliers of that general shape. The embodiment of FIG. 2 has the same structural features and is used in the same way as the embodiment of FIG. 1, with the sole exception being the cylindrical shape of the main housing and the cylindrical shape of hoops 34 and 36.

A plurality of wand-accommodating enclosure ports, collectively denoted 40, is formed in main body 12. As depicted in FIGS. 1 and 2, wand 42 is extending through one of said enclosure ports and nozzle 44 at the distal free end of said wand is positioned in close proximity to a part of chandelier 11. Spray 46 is being emitted by said nozzle. Wand 42 can be adjusted from six inches to four feet (6□-4□) in length. It includes an adjustable pressure valve. The tip of the wand head may be angled and turned three hundred sixty degrees (360°).

Spray 46 may be a mist of hot water or it may be a stream of hot air, depending upon the stage of the cleaning process that is underway. More specifically, proximal end 48 of wand 42 is in fluid communication with pump 50 through light-in-weight, insulated flexible hose 52. Pump 50 is in fluid communication with hot water reservoir 54 and with hot air chamber 56. Pump 50, hot water reservoir 54, and hot air chamber 56 are collectively mounted in portable housing 58.

A heating element, not depicted, is positioned within hot water reservoir 54 and is electrically connected to a suitable power source through cord 60 having plug 62 for engaging a wall socket, not illustrated. Pump 50 and an element for heating air, also not depicted, are also electrically connected to said power source in the same way.

After the chandelier is properly enclosed within chandelier enclosure 10, the first step of the cleaning process is to blow dust from the chandelier by operating wand 42 in its hot air blower mode. In the second embodiment, disclosed hereinafter, a hand-held water extractor is operated inside the enclosure to create a suction so that dust blown from the chandelier is collected in the filter of a wet vac that is in fluid communication with the water extractor.

After the dust has been blown off, in this first embodiment, a hot water mist is introduced onto the various parts of the chandelier by an operator who throws a first switch, not illustrated, connecting pump 50 to hot water reservoir 54. The operator controls the flow rate of hot water through wand 42 by manipulation of handle 64 that is pivotally attached to said wand. Handle 64 or a valve connected thereto extends into the lumen of wand 42 and is biased into a position of repose that completely restricts the flow of hot water through said lumen if the handle is not manually compressed against the bias means. A small amount of manual compression allows a relatively small amount of hot water to flow through the lumen per unit of time and further compression increases said flow rate. In this way, an operator can increase the flow rate for parts of the chandelier that require more cleaning and decrease the flow rate for those parts that require less cleaning.

Significantly, the dirt that clings to chandelier crystals is airborne dust and is removed by the spray or mist of hot water emitted by the wand. Tests have shown that no chemicals whatsoever are required to remove the airborne dust.

After dust has been blown off of all surfaces and said surfaces have been sprayed with hot water, the flow of hot water is deactivated and a second switch is thrown to cause the flow of hot air through the lumen of the wand and onto the parts of the chandelier that require drying. Tests have shown that hot air emitted by nozzle 44 completely dries the parts quickly. Thus, the entire cleaning process is completed in the absence of any manual polishing or rubbing of the various parts of the chandelier, i.e., the entire process is touch-free.

The plastic of which chandelier enclosure 10 is made is coated with a polymer to prevent steaming. This enables the operator to see inside the enclosure at all times.

An alternative support structure for chandelier enclosure 10 includes a lift device 15 that may be employed to support enclosure 10 from below. Lift device 15 has a platform 17 supported by wheels 19 and includes an upstanding telescoping arm 21 surmounted by table 23 that may be hydraulically, pneumatically, or mechanically raised and lowered as needed to properly position enclosure 10 in enclosing relation to chandelier 11. It should be understood that FIGS. 1 and 2 depict enclosure 10 both suspended from chain 13 and potentially supported by lift device 15 but both support techniques are alternatives to each other and would not likely be employed at the same time.

Figure 3:
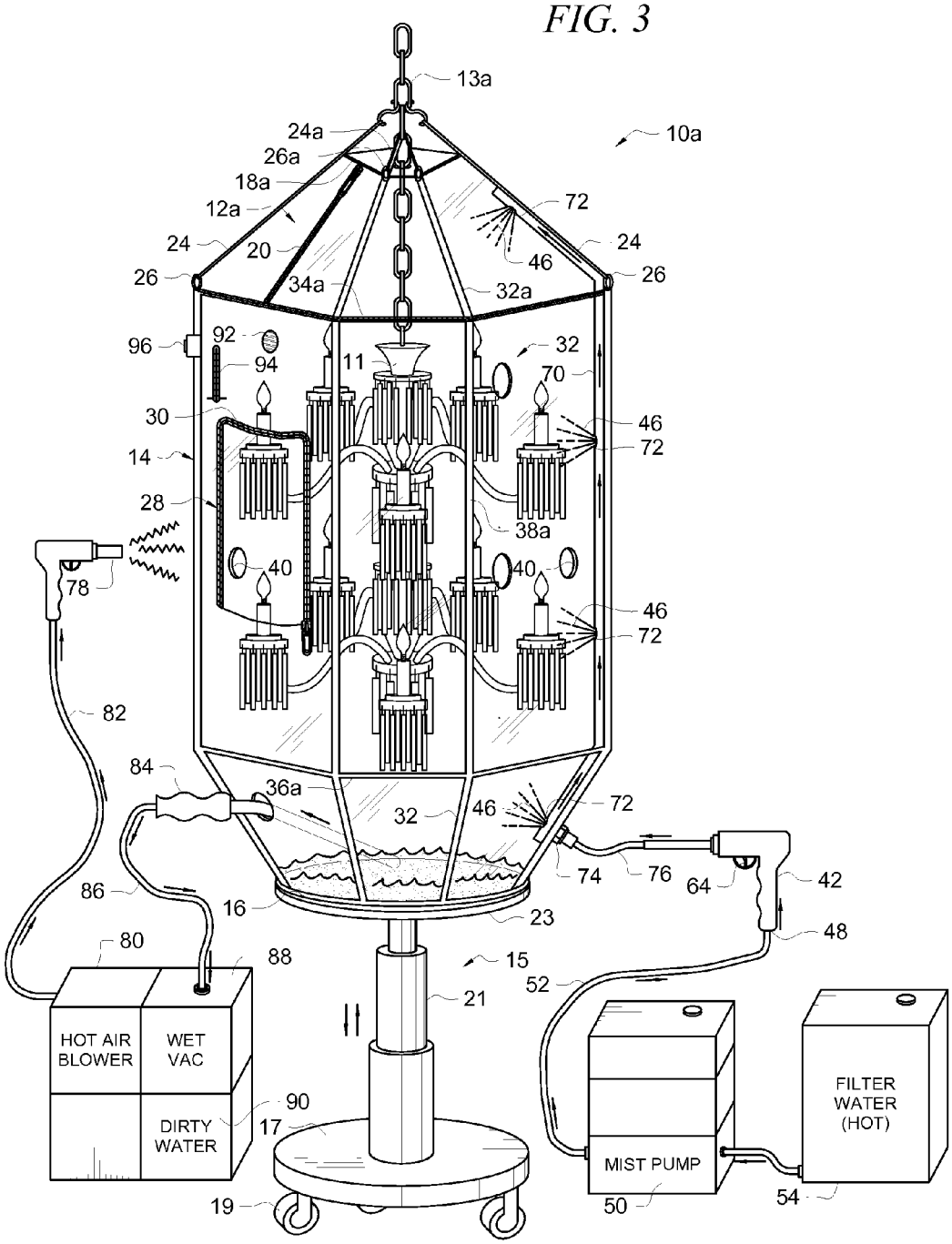
FIG. 3 is a perspective view of a second embodiment.

The second, more advanced embodiment of the invention is depicted in FIG. 3. The parts of this second embodiment that are the same parts as the first embodiment are identified by the same reference numerals as used in the first embodiment. Parts that are similar or substantially the same use the same reference numerals followed by the first letter of the alphabet in lower case.

The second embodiment adds a swivel device 13*a* from which the novel enclosure may be suspended. Swivel device 13*a* may be suspended from a ceiling hook, not depicted, or from chain 13 that suspends chandelier 11. The swivel enables the operator to rotate chandelier enclosure 10 about a vertical axis as a part of the cleaning process as disclosed below.

Unlike flat, horizontally-disposed top panel 12 of the first embodiment, this second embodiment includes a frusto-conical top panel 12*a* that is inclined at an angle, roughly forty five degrees (45°). Said top panel 12*a* is preferably removably secured to main body 14 so that it may be fully detached therefrom. Any suitable releasable connection may be employed at the interface of top panel 12 and main body 14 such as hook and loop fastening means, zippers, snaps, and the like. This facilitates entry of a chandelier into the hollow interior of the main body of the enclosure. After the chandelier is within said hollow interior, top panel 12 is easily re-attached.

A rigid frame of inclined rods, collectively denoted 32*a*, divides top panel 12*a* into sections that are integrally formed with one another. Each section is flat and is wider at its bottom than at its top. The top of each section is parallel to its bottom so that central opening 18*a* is formed at the center of the top panel. In this eight-sided embodiment, the opening is octagonal. A six-sided enclosure would have a hexagonal opening, and so on. One of the panels is zippered as at 20 so that when the zipper is open, top panel 12*a* may be opened widely as in the first embodiment to allow chandelier 11 or other fixture to pass therethrough upon entering or exiting the novel structure. Such an opening is particularly helpful where a fixture is flush mounted to a ceiling.

This second embodiment also adds inside misters 70 which are activated after chandelier 11 has been properly enclosed within novel enclosure 10*a* and dust has been blown therefrom. Such misters are built into the enclosure. A plurality of mist-dispensing nozzles 72 is formed in each inside mister 70 along the respective lengths of each inside mister. The number and location of the inside misters may be changed for different jobs. The inside mister provides upward, horizontal, and downward water force to remove airborne dirt and dust.

The swivel member mentioned above enables the operator to rotate chandelier enclosure 10 about a vertical axis so that inside misters 70 follow a path of travel that encircles the stationary chandelier. If only one inside mister is used, the operator needs to rotate chandelier enclosure 10 a full three hundred sixty degrees (360°) about the vertical axis defined by swivel device 13*a*. It is more practical to provide three (3) inside misters, circumferentially spaced one hundred twenty degrees (120°) from one another, so that the operator needs only to rotate enclosure 10 about one hundred twenty degrees (120°).

For an eight-sided enclosure, such as the one depicted, the number of such inside misters would be eight (8) if one mister is mounted in each interior corner of the enclosure. However, as a practical matter, the number of misters in most applications will be about three. Although the inside misters are an important part of the second embodiment, the number of such inside misters is not a critical part of this invention.

One of the inside misters has a connector 74 mounted on the outside of enclosure 10 to enable a user to attach hose 76 to said connector. The proximal end of hose 76 is connected to hand-held spray gun 42*a* which is in fluid communication with mist pump 50 and a source of hot, filtered water 54. The user pulls trigger 64 of gun 42*a* and the inside misters 70 spray chandelier 11 or other fixture as the operator rotates chandelier enclosure 10 about its vertical axis of symmetry, said vertical axis being defined by said swivel member 13*a* as aforesaid.

Unlike the first embodiment, spray gun 42*a* does not perform the dual function of misting and drying. In this second embodiment, the drying function is performed by dedicated hot air dryer 78 that is in fluid communication with hot air blower 80 by means of elongate flexible hose 82. Hot air dryer 78 is inserted through ports 40 to dry chandelier 11 after the hot misting process is finished. More particularly, after the misting step is completed, the crystal and metal start drying because they have been heated by the hot water. The hot air dryer keeps the inside continually hot and maintains the drying process. The hot air dryer may also be used to pre-heat the fixture prior to the commencement of the misting process.

To remove water that accumulates atop floor panel 16, this second embodiment adds hand-held water extractor 84 that is in fluid communication by means of elongate flexible hose 86 with wet vac 88 that includes dirty water reservoir 90. Water extractor 84 has variable tips attached to the end. After the misting process has been completed, water extractor 84 is employed to remove water that may collect in various bowls formed by the fixture, atop bottom wall 16 of enclosure 10 and other water-collecting areas. The nozzle of water extractor 84 is inserted through an enclosure port 40 and extracts the water into said wet vac.

Hot air dryer 78 also serves as a duster. By inserting and operating hand-held water extractor 84 into an enclosure port 40 before the misting process starts, followed by activation of hot air dryer 78 to blow off dust, said dust is vacuumed from the enclosed area. Specifically, the dust is carried to a micron filter in water vac 88 that prevents reintroduction of the dust back into the room in which the chandelier is mounted.

Further improvements provided by this second embodiment include hot air vent 92, temperature gauge 94, and pressure-relief valve 96, each of which performs a function expressed by it name.

The novel combination of an enclosure, hot mist, and variable pressure heats the fixture and all parts with spotless results. Since chandeliers have only airborne contaminants such as dust, a mild to aggressive cleaning agent is not needed. The novel method is environmentally safe, chemical-free, and thus constitutes the purest way to clean a chandelier or other fixture.

Chemical sprays often leave residue in areas that dry out; the residue can ignite and cause flames in sockets. The novel system leaves no residue and thus eliminates that danger. The novel method also keeps crystals and fixtures cleaner much longer than conventionally-cleaned crystals and fixtures because there is no rubbing and buffing to cause static for dust to adhere to.

The novel process is thus understood to use heat to warm the crystal and the metal parts of the fixture. This helps to dry the components by causing evaporation of the remaining moisture after misting has been used to remove the dirt. The heat is introduced by the hot mist of wand 42 or spray gun 42*a* and the hot air of dryer 78. Such heat and evaporation help inhibit or prevent spotting.

Modern chandeliers include crystal positioned in areas between and behind other components and no prior art method can effectively reach such crystals. The novel method not only reaches such hard-to-reach areas, the cleaning process can also detail the cleaning to pinpoint certain areas.

Electricity to the fixture is turned off during the cleaning process and the plastic used in the enclosure is nonconductive. The hand-held wand, the hand-held hot air dryer, and the hand-held water extractor are all made of nonconductive plastic.

It will be seen that the advantages set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention that, as a matter of language, might be said to fall therebetween.

What is claimed is:

1. An apparatus for touchless cleaning of chandeliers, comprising:

a tent-like enclosure having a predetermined shape adapted to house a chandelier therein;

said tent-like enclosure having a hollow interior;

a top panel formed integrally with said tent-like enclosure;

an imperforate floor panel secured to a lower peripheral edge of said tent-like enclosure;

a central aperture formed in said top panel;

a slot formed in said top panel that extends radially from said central aperture to a peripheral edge of said top panel;

a closure means for selectively opening and closing said slot;

said slot when open adapted to enable a chandelier to pass through said central opening and said open slot to position said chandelier in said hollow interior of said tent-like enclosure;

said slot when closed adapted to enclose said chandelier within said hollow interior of said tent-like enclosure;

a hand-held wand having a nozzle at a distal end thereof;

said hand-held wand having a first operating mode and a second operating mode;

at least one wand-accommodating port formed in said main body of said tent-like enclosure;

a hot water reservoir disposed outside of said tent-like enclosure;

a hot air chamber including a hot air blower disposed outside of said tent-like enclosure;

a pump in fluid communication with said hot water reservoir;

said hand-held wand being in selective fluid communication with said pump when operating in said first mode and said hot air blower when operating is said second mode;

said pump adapted to pump hot water from said hot water reservoir into said hand-held wand so that said hot water is sprayed onto said chandelier when said hand-held wand is operated in said first mode;

said hot air blower adapted to blow hot air into said hand-held wand so that said hot air is blown onto said chandelier when said hand-held wand is operated in said second mode;

a plurality of mist-spraying nozzles mounted within said tent-like enclosure;

said tent-like enclosure having a first position of rotational adjustment where said plurality of mist-spraying nozzles mounted within said tent-like enclosure applies a mist of hot water to at least a first part of said chandelier;

said tent-like enclosure having a second position of rotational adjustment where said plurality of mist-spraying nozzles mounted within said tent-like enclosure applies a mist of hot water to at least a second part of said chandelier that is circumferentially spaced apart from said first part of said chandelier; and said plurality of mist-spraying nozzles being in fluid communication with said hand-held wand so that hot water is sprayed in mist form by said plurality of mist-spraying nozzles when said hand-held wand is operated in said first mode.

2. The apparatus of claim 1, further comprising:

said closure means being a zipper.

3. The apparatus of claim 1, further comprising:

an access door formed in said tent-like enclosure.

4. The apparatus of claim 3, further comprising:

said access door being hingedly secured to said tent-like enclosure by a living hinge; and a door zipper for engaging said access door to said tent-like enclosure when said access door is closed, said door zipper being unzipped to enable opening of said access door.

5. The apparatus of claim 1, further comprising:

a support frame for maintaining said predetermined shape of said tent-like enclosure;

said support frame including a plurality of relatively rigid parts that cooperate with one another to hold said tent-like enclosure in said predetermined shape.

6. The apparatus of claim 5, further comprising:

said predetermined shape being an oblong shape.

7. The apparatus of claim 5, further comprising:

said predetermined shape being cylindrical.

8. The apparatus of claim 5, further comprising:

a first hoop having a predetermined shape positioned within said hollow interior at an upper peripheral edge of said tent-like enclosure;

a second hoop having a predetermined shape positioned within said hollow interior at a lower peripheral edge of said tent-like enclosure;

said first and second hoops being oriented in a substantially horizontal plane;

said first and second hoops being interconnected to one another by a plurality of relatively rigid upstanding rods that are disposed in parallel, equidistantly and circumferentially spaced relation to one another within said hollow interior;

said first and second hoops and said rods collectively holding said tent-like enclosure in spaced relation to said chandelier so that the tent-like enclosure does not touch said chandelier.

9. The apparatus of claim 1, further comprising:

a ceiling-mounted chain disposed in a vertical plane;

said chandelier connected to a free end of said ceiling-mounted chain;

a first end of two non-stretchable lines secured to said chain and a second end of each non-stretchable line secured to an upper peripheral edge of said tent-like enclosure.

10. The apparatus of claim 1, further comprising:

said hand-held wand including a flow control means so that an operator may control the flow rate of hot water and hot air onto said chandelier.

11. The apparatus of claim 1, further comprising:

a lift device for supporting said tent-like enclosure from below.

12. The apparatus of claim 11, further comprising:

said lift device including a base supported by wheels;

said lift device including a telescoping arm disposed in upstanding relation to said base;

a flat platform that surmounts said telescoping arm;

said flat platform supporting said imperforate floor panel so that said tent-like enclosure may be disposed in enclosing relation to said chandelier when said tent-like enclosure is not suspended from a chain that supports said chandelier.

13. An apparatus for touchless cleaning of chandeliers, comprising:

a tent-like enclosure having a predetermined shape adapted to house a chandelier therein;

said tent-like enclosure having a hollow interior;

a top panel detachably secured to said tent-like enclosure;

said top panel including a plurality of sections, each of which is angled with respect to a horizontal plane, and each section being wider at its bottom than at its top;

a central opening formed in said top panel;

an imperforate floor panel detachably secured to a lower peripheral edge of said tent-like enclosure;

a slot formed in said top panel that extends radially from said central opening to a bottom peripheral edge of said top panel;

a closure means for selectively opening and closing said slot;

said slot when open adapted to enable a chandelier to pass through said central opening and said open slot to position said chandelier in said hollow interior of said tent-like enclosure;

said slot when closed adapted to enclose said chandelier within said hollow interior of said tent-like enclosure;

a hand-held spray gun having a spray-emitting nozzle at a distal end thereof;

at least one spray gun-accommodating port formed in said main body;

a mist pump;

a detergent-free reservoir of hot water;

said mist pump in fluid communication with said reservoir of detergent-free hot water;

said hand-held spray gun having a proximal end in fluid communication with said pump;

a hand-held hot air dryer having a hot-air outlet at a distal end thereof;

a hot air blower; and said hand-held hot air dryer having a proximal end in fluid communication with said hot air blower;

a plurality of mist-spraying nozzles mounted within said tent-like enclosure;

said tent-like enclosure having a first position of rotational adjustment where said plurality of mist-spraying nozzles mounted within said tent-like enclosure applies a mist of hot water to at least a first part of said chandelier;

said tent-like enclosure having a second position of rotational adjustment where said plurality of mist-spraying nozzles mounted within said tent-like enclosure applies a mist of hot water to at least a second part of said chandelier that is circumferentially spaced apart from said first part of said chandelier;

said plurality of mist-spraying nozzles being in fluid communication with said hand-held spray gun so that hot water is sprayed in mist form by said plurality of mist-spraying nozzles when said hand-held spray gun is in fluid communication with said plurality of mist-spraying nozzles;

whereby application by said hand-held spray gun of a detergent-free mist of hot water to said chandelier, followed by drying of said chandelier by said hand-held hot air dryer results in a clean chandelier; and whereby application by said hand-held hot air dryer of hot air onto said chandelier may precede and follow said application of hot water.

14. The apparatus of claim 13, further comprising:

a support frame for maintaining said predetermined shape of said tent-like enclosure;

said support frame including a plurality of relatively rigid parts that cooperate with one another to hold said tent-like enclosure in said predetermined shape;

a swivel member mounted to a ceiling;

said swivel member defining a vertical axis of rotation;

a first end of two non-stretchable lines secured to said swivel member and a second end of each non-stretchable line secured to an upper peripheral edge of said tent-like enclosure.

15. The apparatus of claim 13, further comprising:

a lift device for supporting said tent-like enclosure from below;

said lift device including a base supported by wheels;

said lift device including a telescoping arm disposed in upstanding relation to said base;

a platform that surmounts said telescoping arm;

said platform supporting said imperforate floor panel so that said tent-like enclosure may be disposed in enclosing relation to said chandelier when said tent-like enclosure is not suspended from a ceiling hook or chain that supports said chandelier.

16. A touchless method of cleaning a chandelier, comprising the steps of:

enclosing a chandelier in a see-through enclosure that completely encloses said chandelier and that traps water inside said see-through enclosure;

performing said step of enclosing said chandelier when said chandelier is in its operating position;

providing a first and a second port in said enclosure;

providing a hand-held hot air dryer that is in fluid communication with a source of hot air;

providing a hand-held vacuum device that is in fluid communication with a source of negative pressure;

providing a hand-held wand having a nozzle at a distal end thereof, said hand-held wand having a first operating mode and a second operating mode;

providing at least one wand-accommodating port formed in said main body of said enclosure providing a plurality of mist-spraying nozzles mounted within said see-through enclosure;

wherein said see-through enclosure has a first position of rotational adjustment where said plurality of mist-spraying nozzles mounted within said enclosure applies a mist of hot water to at least a first part of said chandelier;

wherein said see-through enclosure has a second position of rotational adjustment where said plurality of mist-spraying nozzles mounted within said enclosure applies a mist of hot water to at least a second part of said chandelier that is circumferentially spaced apart from said first part of said chandelier; and wherein said plurality of mist-spraying nozzles are in fluid communication with said hand-held wand so that hot water is sprayed in mist form by said plurality of mist-spraying nozzles when said hand-held wand is operated in said first mode;

providing a third port in said enclosure;

providing a mist pump;

providing a source of hot water in fluid communication with said mist pump;

providing a hand-held spray gun that is in fluid communication with said mist pump;

inserting said hand-held hot air dryer into said enclosure through said first port;

inserting said hand-held vacuum device into said enclosure through said second port;

substantially simultaneously operating said hand-held hot air dryer and said hand-held vacuum device to blow dust from said chandelier and to collect said dust, respectively;

inserting said hand-held spray gun into said enclosure through said third port and operating said hand-held spray gun to spray a mist of hot water onto said chandelier;

thereafter inserting said hot air dryer into said enclosure through a preselected port and operating said hot air dryer to dry said chandelier.

17. The method of claim 16, further comprising the steps of: inserting said hand-held vacuum device into said enclosure through a preselected port and operating said hand-held vacuum device to vacuum water from said enclosure that has collected atop said bottom panel; and removing said enclosure from said cleaned chandelier; whereby said chandelier remains in its functional, operable position throughout the cleaning process; whereby said chandelier is cleaned in the absence of manual scrubbing of its individual parts; whereby said chandelier is cleaned in the absence of chemicals; and whereby the time required to clean said chandelier is substantially reduced vis a vis manual chandelier cleaning procedures.

* * * * *